US011717096B2

(12) United States Patent
Tasch et al.

(10) Patent No.: US 11,717,096 B2
(45) Date of Patent: Aug. 8, 2023

(54) FOLDABLE HANG TAB

(71) Applicant: Wynalda Litho, Inc., Belmont, MI (US)

(72) Inventors: Josiah Matthew Tasch, Belmont, MI (US); Nathanael Albert Wynalda, Belmont, MI (US); Douglas James Tait, III, Belmont, MI (US)

(73) Assignee: Wynalda Litho, Inc., Belmont, MI (US)

( * ) Notice: Subject to any disclaimer, the term of this patent is extended or adjusted under 35 U.S.C. 154(b) by 92 days.

(21) Appl. No.: 17/181,394

(22) Filed: Feb. 22, 2021

(65) Prior Publication Data

US 2021/0259437 A1 Aug. 26, 2021

Related U.S. Application Data

(60) Provisional application No. 62/980,258, filed on Feb. 22, 2020.

(51) Int. Cl.

| | |
|---|---|
| ***B65D 25/22*** | (2006.01) |
| ***B65D 5/46*** | (2006.01) |
| ***A47F 5/00*** | (2006.01) |
| ***B65D 5/42*** | (2006.01) |

(52) U.S. Cl.

CPC ..... *A47F 5/0006* (2013.01); *B65D 5/4208* (2013.01); *B65D 5/46032* (2013.01); *B65D 25/22* (2013.01)

(58) Field of Classification Search

CPC ..... B65D 5/4208; B65D 5/46032; B65D 73/0071; B65D 25/22

USPC ..... 229/117.09, 117.17–117.19, 229/117.22–117.24; 206/284, 806

See application file for complete search history.

(56) References Cited

U.S. PATENT DOCUMENTS

| | | | | |
|---|---|---|---|---|
| 1,144,637 A * | 6/1915 | Campbell | B65D 5/46064 | 229/117.14 |
| 1,877,601 A * | 9/1932 | Shapiro | B65D 5/46032 | 229/117.14 |
| 2,138,336 A * | 11/1938 | Bronstein | B65D 5/46032 | 229/117.24 |
| 2,220,913 A * | 11/1940 | Ringler | B65D 3/10 | 229/5.5 |
| 2,605,041 A * | 7/1952 | Welshenbach | B65D 5/46032 | 229/117.19 |
| 2,964,227 A | 1/1958 | Goldsholl | | |
| 3,010,571 A | 12/1959 | Transport | | |

(Continued)

FOREIGN PATENT DOCUMENTS

SE 504345 C2 * 1/1997 ..... B65D 5/46032

*Primary Examiner* — Nathan J Newhouse
*Assistant Examiner* — Phillip D Schmidt
(74) *Attorney, Agent, or Firm* — Fred Zollinger

(57) ABSTRACT

A foldable hang tab has a body that includes a hook extending from a base. The hook includes first and second hook portions disposed against one another and joined at a fold. The base includes first and second base portions that partially overlap one another or interlock. The disclosure provides a configuration wherein the base of the foldable hang tab body is configured to be adhered to merchandise or to a merchandise storage container. The disclosure also provides a configuration wherein the base is placed inside a merchandise storage container with the hook protruding through a slot defined by the container.

11 Claims, 5 Drawing Sheets

(56) References Cited

U.S. PATENT DOCUMENTS

| | | | | | |
|---|---|---|---|---|---|
| 3,146,937 | A * | 9/1964 | Vesak | B65D 5/46032 229/117.22 |
| 3,695,508 | A | 10/1972 | Hocking | |
| 3,814,303 | A | 6/1974 | Smith | |
| 3,929,222 | A | 12/1975 | Smith et al. | |
| 4,210,240 | A | 7/1980 | Fricano | |
| 4,403,690 | A * | 9/1983 | Fischer | B65D 5/46072 229/117.22 |
| 4,564,106 | A * | 1/1986 | Shilcock | B65D 71/50 294/87.2 |
| 5,284,294 | A | 2/1994 | Floyd | |
| 5,509,528 | A | 4/1996 | Weisburn | |
| 5,896,996 | A | 4/1999 | Chuang | |
| 5,911,358 | A | 6/1999 | Kenner et al. | |
| 5,924,626 | A | 7/1999 | Whitnell | |
| 6,152,359 | A | 11/2000 | Clark | |
| 6,209,782 | B1 * | 4/2001 | Chou | B65D 5/46088 229/117.22 |
| 6,672,762 | B1 | 1/2004 | Faircloth et al. | |
| 6,719,128 | B2 | 4/2004 | Alpern et al. | |
| 7,128,222 | B2 | 10/2006 | Doucette | |
| 7,178,712 | B2 | 2/2007 | Schultz et al. | |
| 7,413,080 | B2 | 8/2008 | Van House | |
| 7,451,909 | B2 | 11/2008 | Sexton | |
| D614,022 | S | 4/2010 | Melnick | |
| 7,918,338 | B2 * | 4/2011 | Dweck | G09F 23/00 206/467 |
| D640,549 | S | 6/2011 | Atkin et al. | |
| 7,967,186 | B2 * | 6/2011 | Brandinelli | B65D 5/46032 229/117.22 |
| 8,418,858 | B2 | 4/2013 | Foltz et al. | |
| 9,096,360 | B2 | 8/2015 | Rajter, Jr. | |
| 9,133,649 | B2 | 9/2015 | Taylor et al. | |
| 9,681,760 | B1 | 6/2017 | Longberg | |
| 10,661,977 | B2 | 5/2020 | Veret et al. | |
| 2004/0182801 | A1 | 9/2004 | Sedon et al. | |
| 2008/0073246 | A1 | 3/2008 | Herring et al. | |
| 2009/0283556 | A1 | 11/2009 | Ho | |
| 2014/0138262 | A1 | 5/2014 | Rajter | |

* cited by examiner

FOLDABLE HANG TAB

CROSS REFERENCE TO RELATED APPLICATIONS

This application claims the benefit of U.S. provisional application No. 62/980,258 filed Feb. 22, 2020; the disclosures of which are incorporated herein by reference.

BACKGROUND INFORMATION

1. Technical Field

The disclosure generally relates to devices used to display merchandise for viewing by potential consumers and, more particularly, to hang tabs used to hang merchandise or merchandise containers for display. Specifically, the disclosure relates to a foldable hang tab that can be erected from a flat blank of paper, paperboard, or polymer board.

2. Background Information

Different items of merchandise are often displayed at retail locations in a hanging configuration from a hook or a rod. One common configuration is for a plurality of the same items of merchandise to be hung from a common elongated rod. The elongated rod is disposed through an opening defined by the merchandise storage container or by a hang tab projecting from the merchandise storage container. At times, a merchant wants the option of either hanging merchandise or displaying the merchandise on a shelf or table. Companies selecting merchandise packaging thus want to provide both display options without necessarily requiring the inclusion of the hang tab. Also, merchants desire the option of adding a hang tab to merchandise that does not provide for a hanging configuration.

SUMMARY OF THE DISCLOSURE

The disclosure provides different exemplary hang tab configurations that can be folded up to an erected, usable condition from a flat blank. The material of the blank can be matched to the container where the hang tab will be used to allow the items to be recycled together. Once erected, the hang tab can be attached to merchandise with adhesive or in an interference fit. For example, an interference fit is created when a portion of the hang tab is placed inside a merchandise container with a portion of the hang tab projecting out of a slot defined by the container (the slot being smaller than the portion of the hang tab disposed inside the container).

In one configuration, the hang tab has a body that includes a hook and a base. The hook defines an opening adapted to receive a hanger rod. The hook is formed by folding two hook portions to be side-by-side. The hook portions are connected together with a fold or living hinge. The hook portions are each folded up perpendicular to the base to form a single hook. The base includes two base portions that at least partially overlap to define the base.

The disclosure also provides base portions that interlock with each other and/or with the hook. The interlocking configurations can be erected with or without adhesive.

The disclosure provides configurations wherein the hang tab is made from paper, paperboard, or polymer board.

In general, a foldable hang tab includes: a body that includes a hook and a base; the hook including first and second hook portions disposed against one another and joined at a fold; the base including first and second base portions partially overlapping one another; the first base portion being connected to the first hook portion at a fold; and the second base portion being connected to the second hook portion at a fold.

The disclosure provides a configuration wherein the base of the foldable hang tab body is configured to be adhered to merchandise or to a merchandise storage container. The disclosure also provides a configuration wherein the base is placed inside a merchandise storage container with the hook protruding through a slot defined by the container.

BRIEF DESCRIPTION OF THE DRAWINGS

Similar numbers refer to similar parts throughout the specification.

DETAILED DESCRIPTION OF THE DISCLOSURE

A first exemplary configuration of a foldable hang tab is indicated generally by the numeral 2 in the accompany drawings. Hang tab 2 generally includes a base 4 and a hook 6. Hang tab 2 can be folded into the erected position of FIGS. 1 and 2 from the flat condition of FIG. 3. The flat condition of FIG. 3 can be cut from a flat piece of material such as a paper, a paperboard, or a polymer board. The locations where the material is folded can be scored or indented. Adhesive is optionally used to hold adjacent portions together. Hang tab 2 can be made from a recyclable paper or polymer material that matches the container with which it will be used to allow the container and hang tab to be recycled together.

Figure 1:
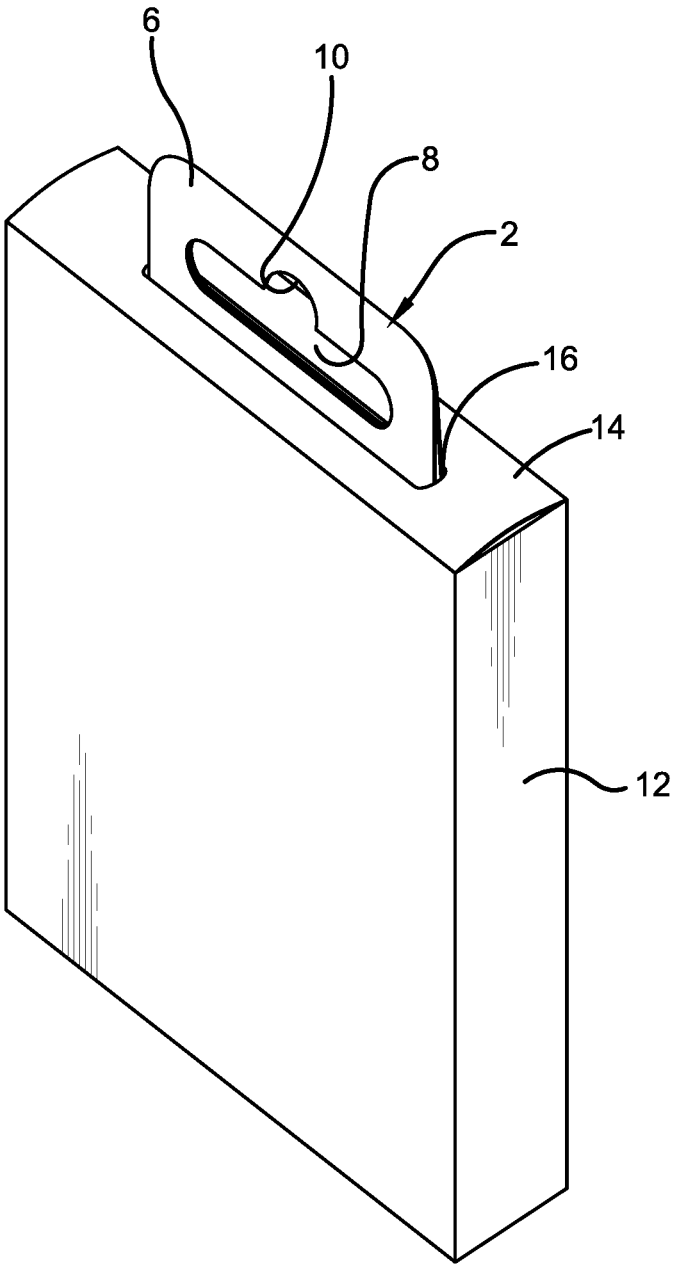
FIG. 1 is a perspective view depicting an exemplary merchandise storage and display container with an exemplary foldable hang tab connected to the container.

Hook 6 defines a through hole 8 that receives a hook, rod, or hanger when hang tab 2 is used to hang an item such as the merchandise storage container 12 depicted in FIG. 1. Although the exemplary configuration of hang tab 2 has a hook 6 defining a fully enclosed, surrounded through hole 8, hook 6 can also be provided with an open side so that hang tab 2 does not have to be placed over the end of a display rod. Through hole 8 is wide enough to receive side-by-side double hooks and defines a peak 10 so that it is self-centering on a single hook.

Base 4 can be connected directly to an item of merchandise or can be connected to merchandise storage container 12 that holds the merchandise. When connected to a merchandise storage container, base 4 can be connected to the outside of the container with an adhesive or, as shown in FIG. 1, base 4 can be positioned inside container 12 or under a panel 14 of container 12 with hook 6 extending out through an opening 16. Opening 16 can be centered with respect to panel 14. In another arrangement, hook 6 projects out from the edge of panel 14 with one section of base 4 disposed under panel 14 and the other section of base 4 extending through a slot defined by the panel located under panel 14 and extending down the back of container 12.

The first exemplary configuration of hang tab 2 has its hook 6 defined by first 20 and second 22 hook portions that are joined together at an upper fold 24. Hook portions 20 and 22 are sized and shaped to match such that they define a common perimeter of hook 6 when folded adjacent each other. Adhesive can be used to join portions 20 and 22 together.

Figure 2:
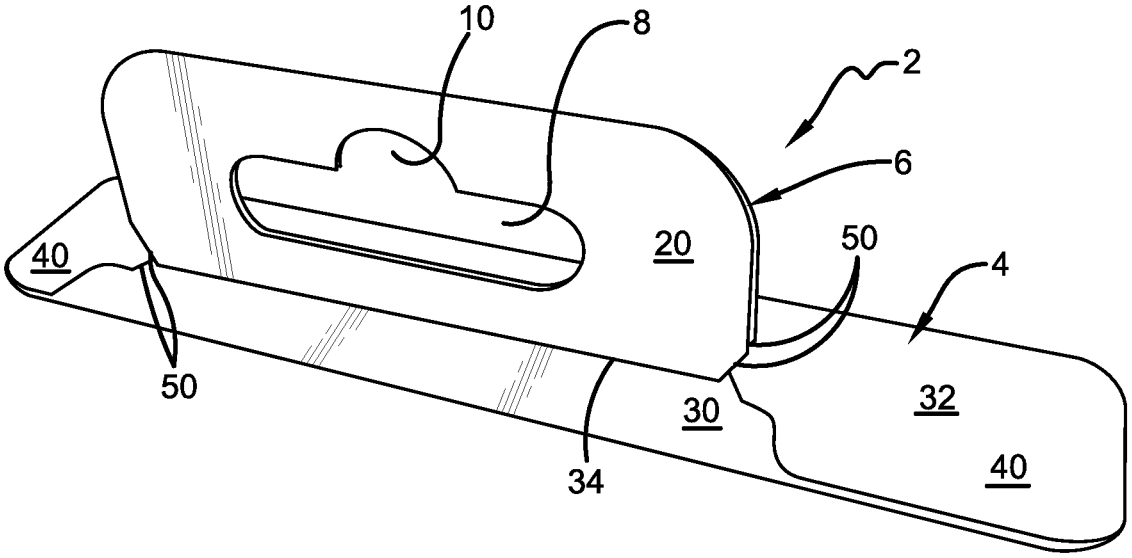
FIG. 2 is a perspective view of the hang tab of FIG. 1.
Figure 3:
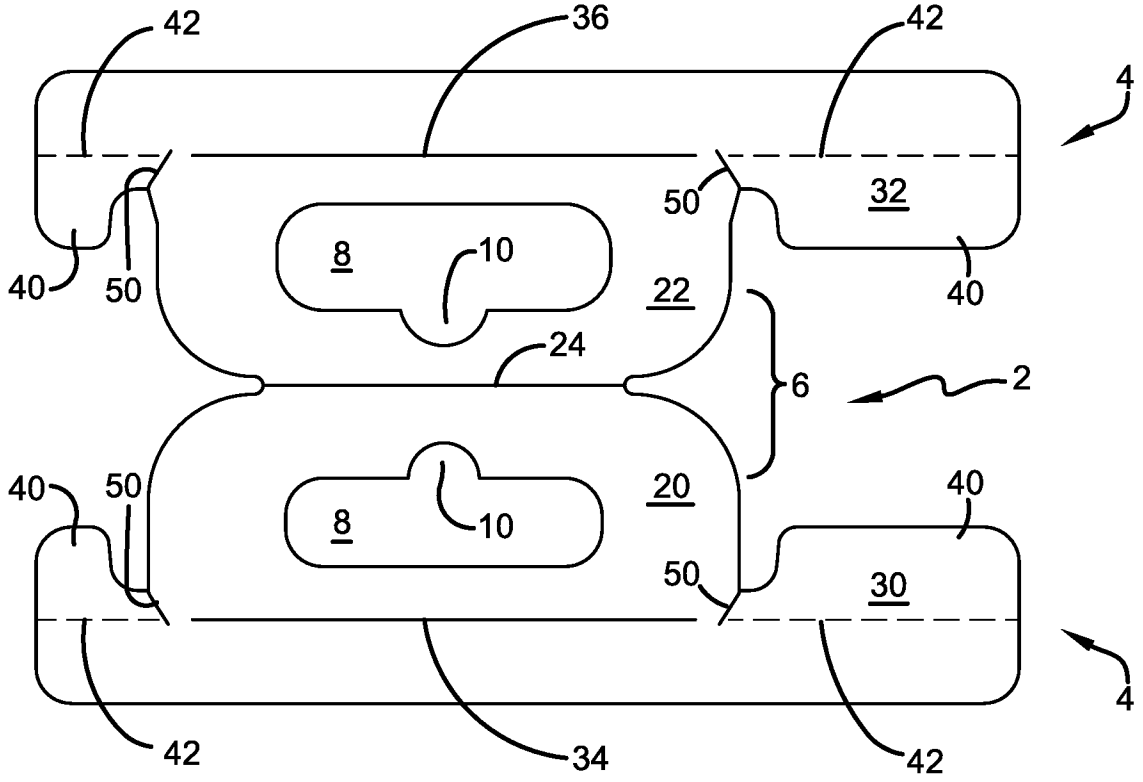
FIG. 3 is a top plan view depicting the hang tab of FIG. 1 in a flat condition.

Base 4 is defined by first 30 and second 32 base portions. First base portion 30 is connected to first hook portion 20 at fold 34. Second base portion 32 is connected to second base portion 32 at fold 36. Base 4 can be sized to match panel 14. In this exemplary configuration, each base portion 30 and 32 includes tabs 40 disposed on the hook side (represented by dashed lines 42) of folds 34 and 36 when hang tab is flat as shown in FIG. 3. As shown in FIG. 2, both tabs 40 from one base portion 32 can be disposed over the top of the other base portion 30. In another configuration, one tab 40 from each base portion 30 and 32 can be on top.

At each end of folds 34 and 36, the junction between hook portions 20/22 and base portions 30/32 is formed as an undercut with cut lines 50 that angle inwardly under hook portions 20/22. These undercuts form inner portions of tabs 40 that are disposed under and interlock with hook 6 as shown in FIG. 2. This interlock helps maintain structural integrity of hang tab 2 and allows it to be erected without adhesive when desired.

Figure 4:
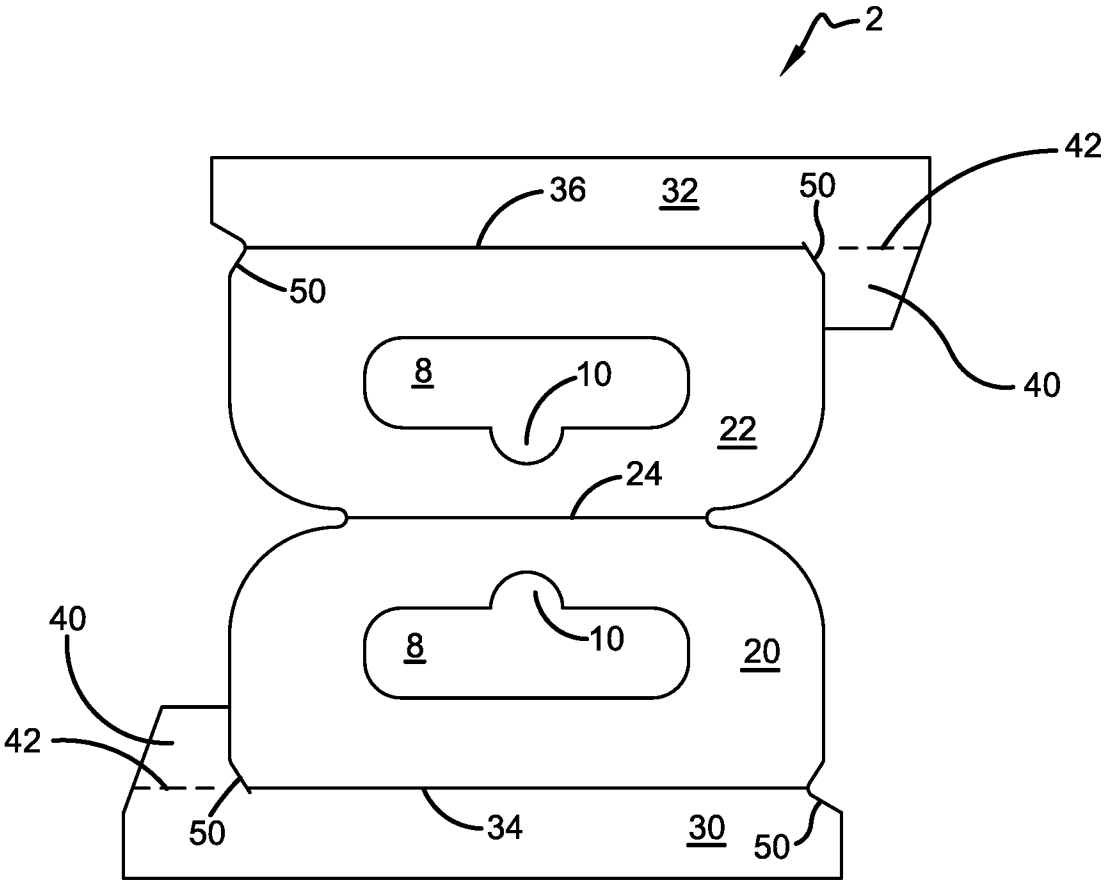
FIG. 4 is a top plan view depicting another exemplary configuration of a hang tab in a flat condition.
Figure 5:
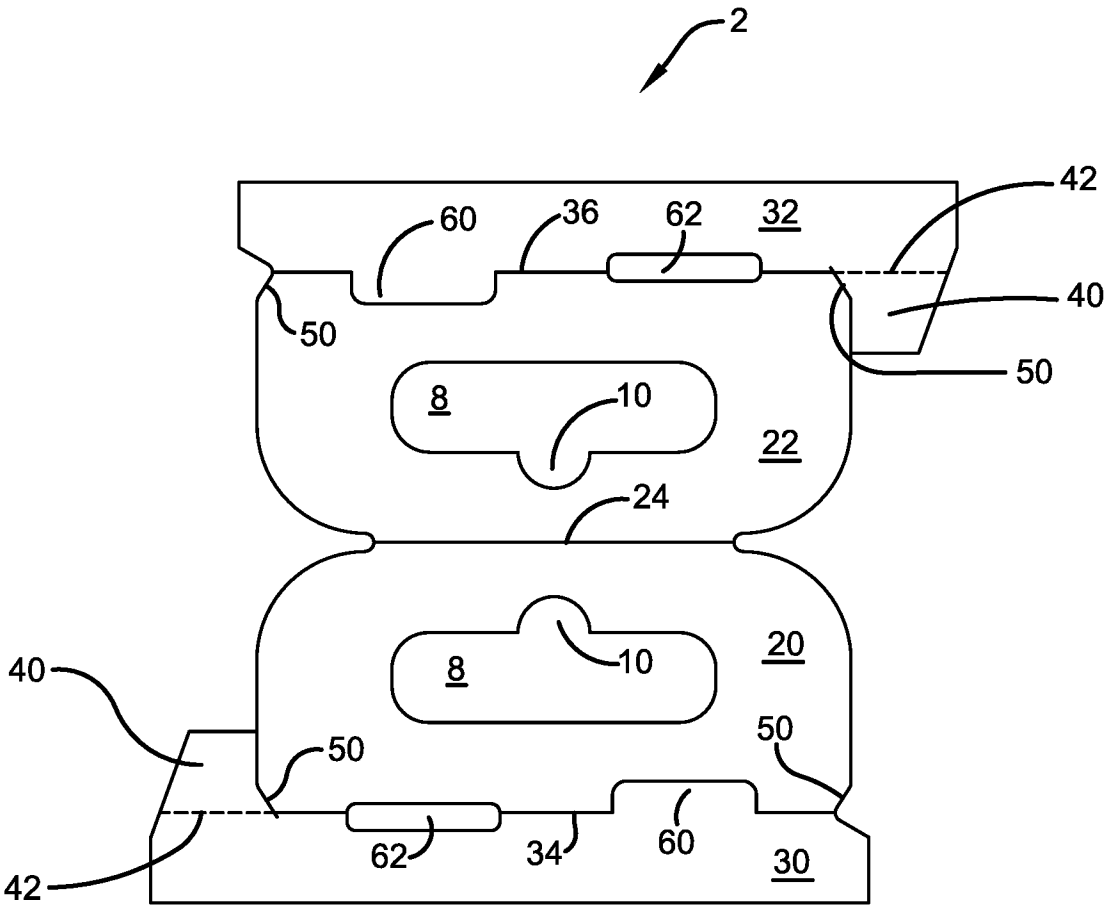
FIG. 5 is a top plan view depicting a further exemplary configuration of a hang tab in a flat condition.

FIG. 4 depicts another exemplary configuration wherein each base portion 30 and 32 includes only a single tab 40. The further exemplary configuration of FIG. 5 includes a locking finger 60 and a locking recess 62 defined along each fold 34 and 36. Each locking finger 60 is disposed in its corresponding locking recess 62 when hang tab 2 is erected to provide an interlocked configuration.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the above description and attached illustrations are an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. A foldable hang tab for use with an item of merchandise or a merchandise storage container; the foldable hang tab comprising:

a base and a hook;

the hook defining a through hole;

the hook including first and second adjacent hook portions;

the base including first and second base portions; the first base portion being connected to the first hook portion at a first connection and the second base portion being connected to the second hook portion at a second connection;

the first base portion including first and second tabs located under the second base portion;

the second base portion including first and second tabs located above the first base portion; and the tabs being positioned outwardly of the first and second connections such that a lower portion of the first hook portion is between the first and second tabs of the second base portion.

2. The foldable hang tab of claim 1, wherein the hook portions are connected together with adhesive.

3. The foldable hang tab of claim 1, wherein the hook portions are connected together with at a fold.

4. The foldable hang tab of claim 3, wherein each of the hook portions has an upper end and a lower end; the upper ends of the hook portions being connected with the fold.

5. The foldable hang tab of claim 4, wherein the lower end of the first hook portion is connected to the first base portion with a fold and wherein the lower end of the second hook portion is connected to the second base portion with a fold.

6. The foldable hang tab of claim 1, wherein the first and second hook portions are sized and shaped to match each other such that they define a common perimeter when disposed adjacent each other.

7. The foldable hang tab of claim 1, wherein the base and hook are made from a paperboard.

8. The foldable hang tab of claim 1, wherein the base and hook are made from a polymer board.

9. The foldable hang tab of claim 1, wherein the through hole is fully surrounded by the material of the hook.

10. The foldable hang tab of claim 1, wherein the through hole is open to a side of the hook.

11. The foldable hang tab of claim 1, wherein the first and second hook portions include undercut outer edges and portions of the tabs of the second base portion are located between the undercut edges of the first hook portion and the first base portion.

* * * * *